US005738154A

United States Patent [19]

Garvey, III

[11] Patent Number: 5,738,154

[45] Date of Patent: Apr. 14, 1998

[54] GASOLINE SPILL ELIMINATOR

[76] Inventor: Thomas G. Garvey, III, 44 Washburne Ave., Berlin, N.J. 08009

[21] Appl. No.: 792,396

[22] Filed: Feb. 3, 1997

[51] Int. Cl.[6] ..... B65B 3/04

[52] U.S. Cl. ..... 141/86; 141/311 A; 141/326; 114/343

[58] Field of Search ..... 141/86–88, 311; 114/343, 325–327; 220/86.1, 86.2

[56] References Cited

U.S. PATENT DOCUMENTS

| | | | |
|---|---|---|---|
| 4,082,125 | 4/1978 | Wilson et al. | 141/86 |
| 4,802,514 | 2/1989 | Morse | 141/86 |
| 5,027,965 | 7/1991 | Dumars | 220/85 |
| 5,070,806 | 12/1991 | Coster | 114/343 |

*Primary Examiner*—J. Casimer Jacyna
*Attorney, Agent, or Firm*—Norman E. Lehrer

[57] ABSTRACT

A gasoline spill eliminator for attachment to the hull of a boat and over an overflow vent stack which extends therefrom. The gasoline spill eliminator includes a container for collecting and storing fuel emitted from the overflow vent stack. The container has a rear wall with an inlet opening therein. A flexible connector member, which includes a first section, a second section, an outer surface and an inner surface, is provided. The inner surface of the connector member defines a bore. The first section is adapted to extend into the container through the inlet opening in the rear wall thereof. The second section of the connector member is adapted to overlie the overflow vent stack which extends from the hull of the boat, and frictionally engage the same.

8 Claims, 2 Drawing Sheets

GASOLINE SPILL ELIMINATOR

BACKGROUND OF THE INVENTION

The present invention is directed toward a gasoline spill eliminator and, more particularly, toward a device for capturing the fuel from the overflow vent stack of a motorboat when the fuel tank of the same is full in order to prevent gasoline from polluting the water.

Many small to mid-size motorboats include a vent stack or tube leading from the gas tank thereof to the exterior of the boat through a vent hole in the hull or side of the same. This vent hole not only allows fumes to vent from the tank but also provides a means for indicating when the fuel tank has been filled to the top. More specifically, when the fuel tank has been filled, a quantity of gasoline or other fuel will pour out of the overflow vent stack and into the water. Not only does this quantity of gasoline or other fuel pollute the waters where the boat is being refueled, but it also can create a serious fire hazard since the fuel tends to float on top of the water, where it remains combustible, instead of mixing with the water.

In recognition of the foregoing, several devices have been developed to prevent the spillage of gasoline from the tank of a boat. U.S. Pat. No. 4,802,514 to Morse, for example, discloses an open receptacle that is secured to the hull of a boat by suction cups beneath the vent stack. Gasoline that exits the vent stack flows downwardly into the receptacle by the force of gravity. This device must be removed every time the boat is refueled.

U.S. Pat. No. 5,070,806 to Coster also discloses a fuel overflow device that includes a receptacle that is secured to the hull of a boat by means of a suction cup. A flexible hose extends from the top of the receptacle to connect the same to the vent tube. The suction cup interferes with the free flow of gas from the container when one attempts to empty the same. This is due to the fact that the suction cup extends from the same end of the container as the discharge spout. Additionally, the Coster device cannot be firmly secured to the hull of the boat.

Existing gas collection devices of the type described above are designed to be removed each the boat is refueled. However, if the tank of the boat is filled in the morning or on cold days, fuel often will escape through the overflow vent stack when the ambient temperature rises above a certain level and the volume of fuel expands. Such expansion also occurs in a winterized boat, which has had its gas tank filled, when the springtime approaches and the days get warmer.

SUMMARY OF THE INVENTION

The present invention is designed to overcome the deficiencies of the prior art discussed above. It is an object of the present invention to provide a gasoline spill eliminator for recapturing fuel from the overflow vent stack of a boat.

It is another object of the invention to provide a device that can be firmly secured to the hull of the boat for extended periods of time.

It is yet another object of the invention to provide a device that can be readily removed from the boat so that the contents contained therein can be recovered and reused.

In accordance with the illustrative embodiments, demonstrating features and advantages of the present invention, there is provided a gasoline spill eliminator for attachment to the hull of a boat and over an overflow vent stack which extends therefrom. The gasoline spill eliminator includes a container for collecting and storing fuel emitted from the overflow vent stack. The container has a rear wall with an inlet opening therein. A flexible connector member, which includes a first section, a second section, an outer surface and an inner surface, is provided. The inner surface of the connector member defines a bore. The first section is adapted to extend into the container through the inlet opening in the rear wall thereof. The second section of the connector member is adapted to overlie the overflow vent stack, which extends from the hull of the boat, and frictionally engage the same.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
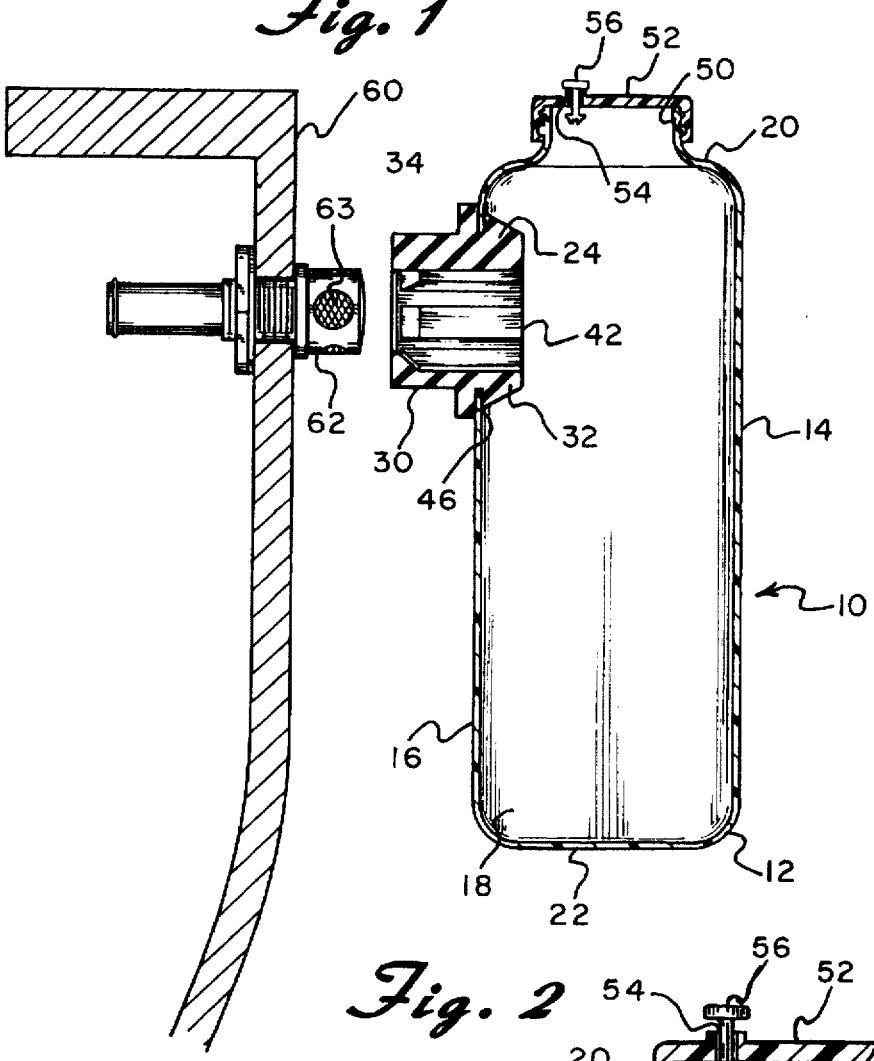
FIG. 1 is a side cross-sectional view of the gasoline spill eliminator of the present invention shown adjacent the hull of a boat.
Figure 2:
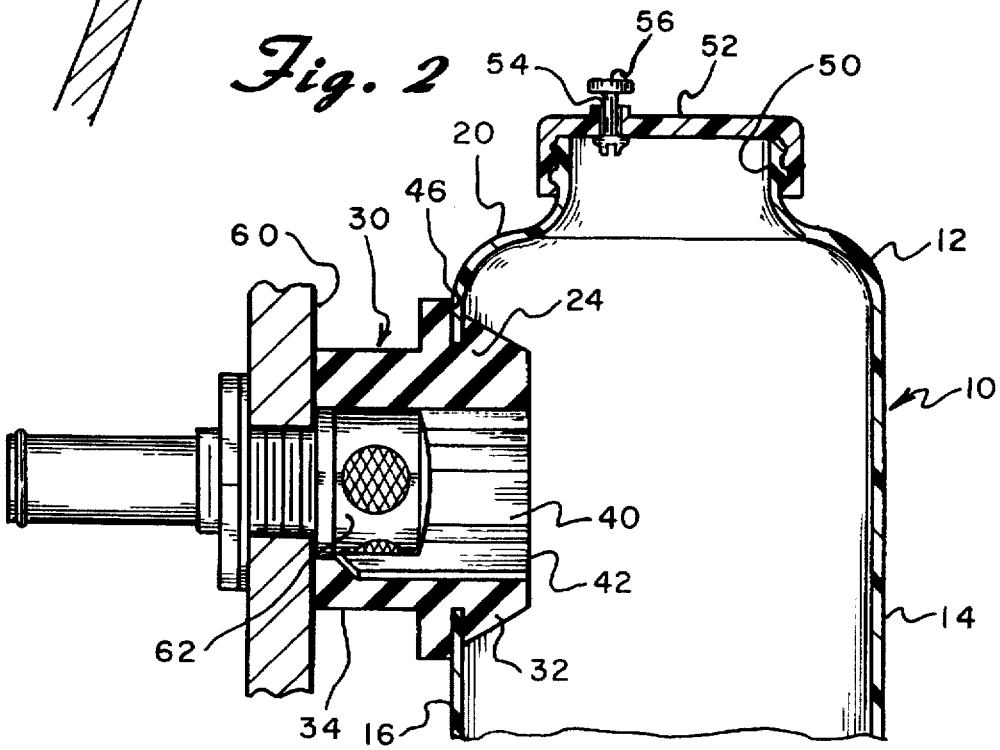
FIG. 2 is a partial side cross-sectional view of the gasoline spill eliminator shown mounted to the hull of the boat.

Referring now to the drawings in detail wherein like reference numerals have been used throughout the various figures to designate like elements, there is shown in FIGS. 1 and 2 a gasoline spill eliminator constructed in accordance with the principles of the present invention and designated generally as 10.

The gasoline spill eliminator 10 includes a container 12 which preferably has a rectangular configuration although it could be made of various shapes. The container 12 has a front wall 14, a rear wall 16, a right wall 18, a left wall, a top wall 20 and a bottom wall 22. The rear wall has an inlet opening 24 formed therethrough. In the preferred embodiment, at least one of the vertical walls or a portion thereof is comprised of a translucent material in order to allow one to visually ascertain whether any fuel has entered the container 12.

Figure 3:
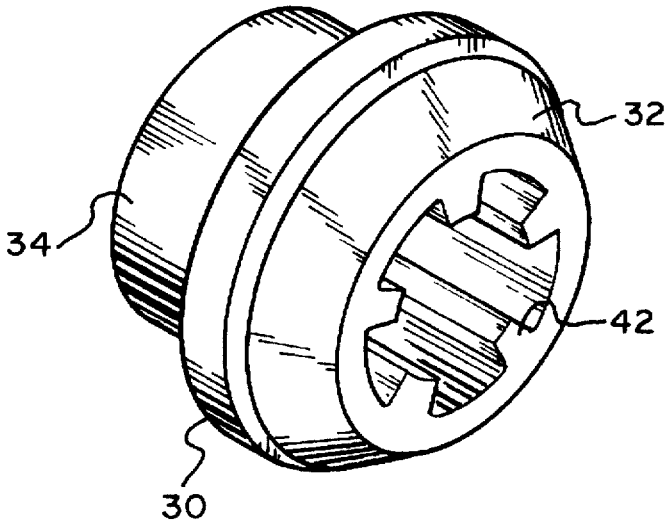
FIG. 3 is a front perspective view of a connector member which is adapted to be secured to and extend from the rear side of the gasoline spill eliminator.
Figure 4:
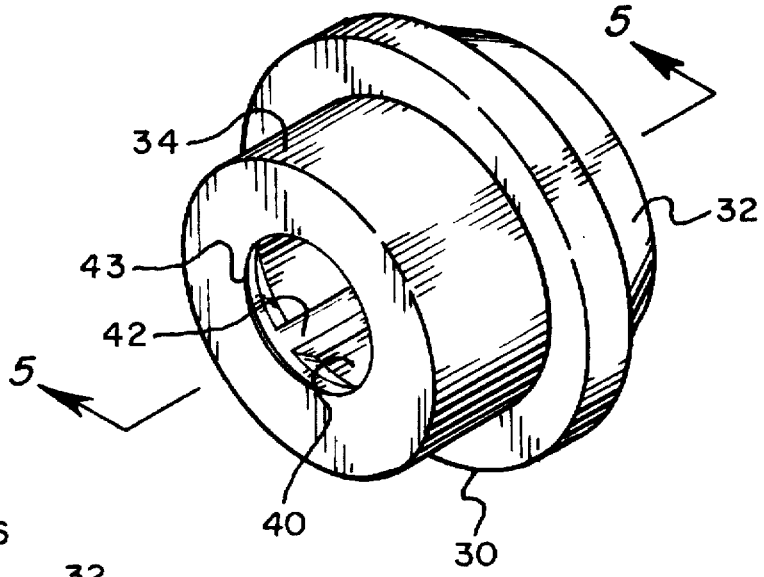
FIG. 4 is a rear perspective view of the connector member.
Figure 5:
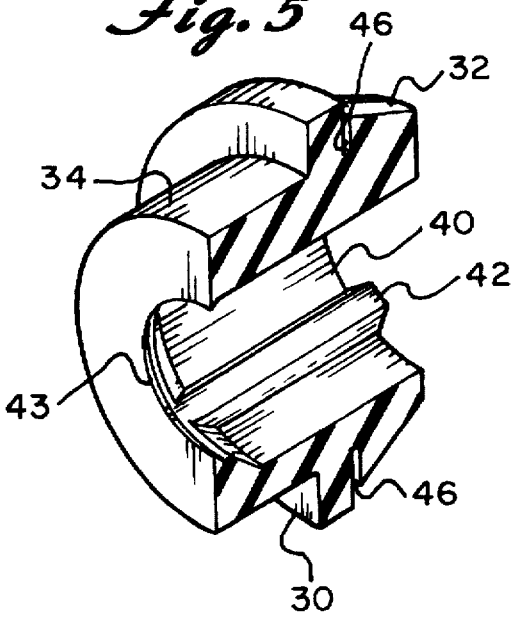
FIG. 5 is a cross-sectional view of the connector member taken along lines 5—5 of FIG. 4.

A flexible connector member 30 is provided (FIGS. 3–5). The connector member includes a first section 32, a second section 34, an outer surface and an inner surface. The inner surface of the connector defines a bore 40, which preferably extends along the length of the connector member. In the preferred embodiment, a plurality of elongated flexible ribs 42 extend along the inner surface of the connector member 30. Adjacent the outermost end of the second section 34 is an additional annular flexible rib 43 which has a height above the inner surface of the bore 40 which is substantially equal to the height of the ribs 42.

The connector member 30 is preferably comprised of a thermoplastic rubber such as Santoprene which is manufactured by Monsanto Chemical of St. Louis, Miss. However, the connector member can be comprised of other flexible polymeric materials. The exterior of the first section 32 is preferably frusto conical in shape. However, the bore 40 which extends through the interior of the first section 32 of the connector member 30 preferably has a uniform diameter.

A groove 46 is formed around the outer surface of the connector member 30 between the first and second sections thereof (FIGS. 1, 2 and 5). The frusto conical shape of the first section 32 of the connector member 30 facilitates the insertion of the same through the inlet opening 24 in the rear wall 16 of the container 12. When the first section 32 of the connector member 30 is inserted into the container, the rear wall 16 of the container engages the groove 46 in the connector member in order to secure the same in place (FIG. 2).

The gasoline spill eliminator 10 further includes a pour spout 50 which extends upwardly from the top wall 20 of the container 12. The pour spout preferably has a plurality of external threads thereon. A cap 52, which includes a plurality of internal threads thereon, is also provided. The internal threads on the cap 52 are adapted to threadably engage the external threads on the pour spout 50 (FIGS. 1 and 2) in order to releasably close the same. The cap preferably has a vent opening 54 therein for allowing fumes to escape from the container 12. A plunger member 56 communicates with the vent opening in order to open and close the same as desired.

In order to facilitate an understanding of the principles associated with the foregoing apparatus, its operation will now be briefly described. When it is time to fill the fuel tank of a boat, the gasoline spill eliminator 10 is mounted to the hull 60 of a boat by inserting the bore 40 in the connector member 30 over the overflow vent stack 62 so that the first section 32 of the connector member contacts the hull (FIGS. 1 and 2). As the connector member is so positioned, the flexible ribs 42 and 43 frictionally engage the vent stack 62 so that the gasoline spill eliminator is firmly secured in place. It should be noted that the connector member could be formed without the ribs 42 but with only the reduced inner diameter portion or rib 43 to frictionally engage the vent stack.

As the boat's fuel tank is being filled, the liquid fuel rises therein until it starts to fill the overflow line. Eventually, the fuel starts to come out of the overflow vent stack 62 through one of the outlets 63 therein. This excess fuel from the overflow vent stack flows through the bore 40 in the connector member and into the interior of the container 12. It should be noted that the space between adjoining ribs 42 allows for a passageway for fuel to travel from one of the outlets 63 on the vent stack 62 through the bore 40 and into the container 12. Since at least a portion of the container is translucent, the operator can observe the fuel flowing into and beginning to fill the container. This serves to indicate to the operator that further refueling is not necessary.

Since the gasoline spill eliminator is firmly secured to the hull of the boat, it can remain in place for extended periods of time. This is particularly advantageous since the fuel within the tank typically expands as the temperature rises throughout the day thereby causing fuel from a filled tank to exit through the vent stack.

When the operator desires to empty the container 12, he simply pulls the device 10 outwardly away from the hull 60 of the boat. Thereafter, the cap 52 can be removed and any fuel in the container can be emptied through the pour spout 50. The gasoline spill eliminator 10 can then be reattached to the hull of the boat in the manner described above.

The present invention may be embodied in other specific forms without departing from the spirit or essential attributes thereof and accordingly reference should be made to the appended claims rather than to the foregoing specification as indicating the scope of the invention.

What is claimed is:

1. A gasoline spill eliminator for attachment to the hull of a boat and over an overflow vent stack extending therefrom comprising:

a container for collecting and storing fuel emitted from said overflow vent stack, said container having a rear wall and a top wall, said rear wall having an inlet opening therein;

a flexible connector member having a first section, a second section, an outer surface and an inner surface, said inner surface defining a bore, said first section being adapted to extend into said container through said inlet opening in said rear wall thereof, said second section being adapted to overlie said overflow vent stack, which extends from said boat, and frictionally engages the same, and means for securing said connector member to said rear wall of said container wherein said securing means includes a groove located around the outer surface of said connector member between said first and second sections thereof, said rear wall extending into and around said groove in said connector member.

2. The gasoline spill eliminator of claim 1 further including a pour spout extending upwardly from said top wall of said container and a cap for releasably closing said pour spout.

3. The gasoline spill eliminator of claim 2 wherein said pour spout includes external threads and said cap includes internal threads, said internal threads on said cap being adapted to threadably engage said external threads on said pour spout.

4. The gasoline spill eliminator of claim 2 wherein said cap includes vent means for allowing fumes to escape the same.

5. The gasoline spill eliminator of claim 1 wherein the exterior of said first section is frusto conical in shape.

6. The gasoline spill eliminator of claim 1 wherein said connector member is comprised of a thermoplastic polymeric material.

7. The connector member of claim 1 further including a plurality of flexible ribs located adjacent said inner surface of said connector member for increasing the frictional contact between said connector member and said overflow vent stack.

8. A gasoline spill eliminator for attachment to the hull of a boat and over an overflow vent stack extending therefrom comprising:

a container for collecting and storing fuel emitted from said overflow vent stack, said container having a rear wall and a top wall, said rear wall having an inlet opening therein;

a flexible connector member having a first section, a second section, an outer surface, and an inner surface, said inner surface defining a bore, said first section being adapted to extend into said container through said inlet opening in said rear wall thereof, said second section being adapted to overlie said overflow vent stack, which extends from said boat, and means for securing said connector member to said rear wall of said container wherein said securing means includes a groove located around the outer surface of said connector member between said first and second sections thereof, said rear wall extending into and around said groove in said connector member.

* * * * *